US007420578B2

(12) United States Patent
Kohira

(10) Patent No.: US 7,420,578 B2
(45) Date of Patent: Sep. 2, 2008

(54) TEMPORARY STOCKING MECHANISM AND PRINTER

(75) Inventor: Hiroyuki Kohira, Chiba (JP)

(73) Assignee: Seiko Instruments Inc. (JP)

( * ) Notice: Subject to any disclaimer, the term of this patent is extended or adjusted under 35 U.S.C. 154(b) by 70 days.

(21) Appl. No.: 11/643,372

(22) Filed: Dec. 21, 2006

(65) Prior Publication Data

US 2007/0158902 A1 Jul. 12, 2007

(30) Foreign Application Priority Data

Jan. 12, 2006 (JP) ..... 2006-004641

(51) Int. Cl.
*B41J 2/32* (2006.01)

(52) U.S. Cl. ..... 347/197

(58) Field of Classification Search ..... 347/197, 347/198, 215, 218, 219, 172, 173, 174, 175, 347/176; 400/120.02, 120.03, 120.04, 120.16, 400/120.17, 618, 636
See application file for complete search history.

(56) References Cited

U.S. PATENT DOCUMENTS 5,038,155 A * 8/1991 Yamagishi et al. ..... 347/198
5,468,080 A * 11/1995 Jones ..... 400/618
5,743,663 A * 4/1998 Imai ..... 400/120.04

* cited by examiner

*Primary Examiner*—K. Feggins
(74) *Attorney, Agent, or Firm*—Adams & Wilks

(57) ABSTRACT

A printer is provided with a printing means for effecting printing on a sheet material, and a temporary stocking mechanism for temporarily stocking the sheet material on which printing is effected. The temporary stocking mechanism is provided with a temporary stocking member having a cylindrical take-up space in which the sheet material is taken up, for temporarily stocking the sheet material on which printing is effected by a printing means, a take-up roller provided in the take-up space, for taking up the sheet material, a driving means for rotationally driving the take-up roller, and a press-contact means for bringing a peripheral surface of the take-up roller into press contact with an inner peripheral surface of the temporary stocking member.

12 Claims, 4 Drawing Sheets

TEMPORARY STOCKING MECHANISM AND PRINTER

This application claims priority to Japanese Patent Application No. 2006-004641 filed Jan. 12, 2006, the entire content of which is hereby incorporated by reference.

BACK GROUND OF THE INVENTION

The present invention relates to a temporary stocking mechanism for temporarily stocking a sheet material by taking up the sheet material on which printing is effected and a printer equipped with the temporary stocking mechanism.

As a label used while being affixed to a product, there is proposed a label issued from a sheet material obtained by providing a printing layer to one surface of a sheet-like base material and a heat-sensitive adhesive layer to the other surface thereof.

In general, a printer for effecting printing on the label having the heat-sensitive adhesive layer includes a sheet supply device for supplying the sheet material, a printing device for printing various kinds of information on the printing layer of the sheet material supplied from the sheet supply device, a cutting device for cutting the sheet material on which printing is effected by the printing device, and a thermal activation device for thermally activating the heat-sensitive adhesive layer of the sheet material.

Disclosed as a conventional printer including the thermal activation device has a structure in which between the cutting device and the thermal activation-device, a guiding device is arranged, for guiding the sheet material while allowing the sheet material to be deformed.

Further, disclosed as a mechanism for temporarily stocking the sheet material, on which printing is effected, in the device is a conventional printer including a space for stocking the sheet material on which printing is effected while keeping the sheet material dangling due to a weight thereof.

However, the mechanism for temporarily stocking the sheet material in the related art adopts a method in which the sheet material on which printing is effected is deformed into a U-shape or in a bellows-like fashion, or kept dangling in a predetermined space until a predetermined processing, such as printing or sheet cutting is completed.

As a result, there arises a problem in that in order to stock the sheet material, it is required to prepare a large space.

Further, there is also a problem in that an enlargement of the space for stocking the sheet material causes an increase in. size of the device as a whole. Accordingly, the temporary stocking mechanisms according to the related art cannot be applied to a small mobile printer which can be easily carried with one hand.

As a counter measure for the problems, a structure is devised in which between a printing device and a thermal activation device, there is provided a temporary stocking portion for temporarily stocking the sheet material by taking up the sheet material on which printing is effected and for extracting the taken up sheet materials toward the thermal activation device by drawing out the taken up sheet materials. The temporary stocking portion is provided with a temporary stocking member including a cylindrical take-up space in which the sheet material on which printing is effected by the printing device is taken up.

However, in the temporary stocking portion, while transport rollers for transporting the sheet material on which printing is effected by the printing device rotate, the sheet material is pushed by the transport rollers into the take-up space of the temporary stocking member fixed in position, to thereby be successively taken up from an outer side toward an inner side. At this time, the sheet material on an outermost side to be taken up in the take-up space is pushed by the transport rollers, thereby taking up the sheet material.

Accordingly, as a length of the sheet material taken up in the take-up space increases, a distance between the transport rollers and a leading edge of the sheet material in the take-up space along the length of the sheet material increases. As a result, it is difficult to transmit a force of the transport rollers with which the sheet material is pushed in a lengthwise direction of the sheet material, thereby causing the sheet material to be deflected at a midpoint thereof.

That is, with regard to the temporary stocking portion described above, there is a fear that the sheet material cannot be smoothly taken up in the take-up space depending on a level of rigidity, that is, a so-called elasticity of the sheet material itself. In particular, there is a problem in that when a sheet material having a relatively small width of about 30 mm is used, the level of elasticity of the sheet material itself is low, so the sheet material is caused to -buckle while being taken up in the take-up space, so satisfactory rolling cannot be achieved.

Further, in the temporary stocking portion described above, the sheet material rolled in the take-up space is taken up such that a side, of the heat-sensitive adhesive layer faces inwardly in the take-up space. The leading edge of the sheet material is advanced in the take-up space and the sheet material with the leading edge is wound in the take-up space one turn, and then, the leading edge abuts on the heat-sensitive adhesive layer of the sheet material on the outer side. Therefore, the leading edge suffers a relatively large damage due to the heat-sensitive adhesive layer. Accordingly, there is a problem in that an operation of taking up the sheet material stops, so the sheet material is not satisfactorily taken up in the take-up space, therefore a length of the sheet material capable of being taken up in the take-up space is short.

Thus, in the temporary stocking member, when, for example, the sheet material having a width of about 30 mm to 50 mm is advanced into the cylindrical take-up space having an inner diameter of about 25 mm, the sheet material is wound in the take-up space about one turn, so it is only possible to take up the sheet material having a length of about 100 mm.

Further, as a counter measure for smoothly guiding the sheet material to be taken up in the take-up space, it is thought that a spiral-shape guide portion for guiding the sheet material is molded out of a resin material to be integral with the temporary stocking member. However, when the guide portion is molded to be integral with the temporary stocking member, a radius of curvature of the guide portion is smaller than a radius of curvature of an inner peripheral surface of the temporary stocking member, so a transportation load of the sheet material increases. Therefore, by molding the guide portion integrally with the temporary stocking member, there is a disadvantage in that a length of the sheet material to be taken up, that is, an amount of the sheet material which can be taken up is reduced.

Thus, it is an object of the present invention to provide a temporary stocking mechanism capable of down-sizing a temporary stocking member, improving reliability of an operation of taking up a sheet material, and increasing a length of the sheet material to be taken up in a take-up space of the temporary stocking member and a printer equipped with the temporary stocking mechanism.

SUMMARY OF THE INVENTION

In order to achieve the above-mentioned object, the temporary stocking mechanism according to the present invention includes: a temporary stocking member having a cylindrical take-up space in which a sheet material is taken up, for temporarily stocking the sheet material on which printing is effected by a printing means; a take-up roller provided in the take-up space, for taking up the sheet material; a driving means for rotationally driving the take-up roller; and a press-contact means for bringing a peripheral surface of the take-up roller into press contact with an inner peripheral surface of the temporary stocking member.

According to the temporary stocking mechanism of the present invention structured as described above, the sheet material advanced into the take-up space of the temporary stocking member advances along the inner peripheral surface of the temporary stocking member to be sandwiched between the inner peripheral surface of the temporary stocking member and the peripheral surface of the take-up roller. The sheet material sandwiched between the temporary stocking member and the take-up roller is advanced in a satisfactory manner as the take-up roller is rotationally driven by the driving means. The sheet material is then smoothly taken up along the inner peripheral surface of the temporary stocking member.

Further, another temporary stocking mechanism according to the present invention includes: a temporary stocking member having a cylindrical take-up space in which a sheet material is taken up, for temporarily stocking the sheet material on which printing is effected by a printing means; a take-up roller provided in the take-up space, for taking up the sheet material; a driving means for rotationally driving the take-up roller; a press-contact member brought into press contact with the take-up roller; and a press-contact means for pressing the press-contact member against a peripheral surface of the take-up roller.

According to the temporary stocking mechanism of the present invention structured as described above, the sheet material advanced into the take-up space of the temporary stocking member advances along the inner peripheral surface of the temporary stocking member to be sandwiched between the press-contact member and the peripheral surface of the take-uproller. The sheet material sandwiched between the press-contact member and the take-up roller is advanced in a satisfactory manner as the take-up roller is rotationally driven by the driving means. The sheet material is then smoothly taken up along the inner peripheral surface of the temporary stocking member.

Further, the temporary stocking member of the temporary stocking mechanism according to the present invention is composed of a plurality of members which are combined with one another so as to be capable of being separated so that the take-up roller is exposed to the outside. With this construction, even in a case where a problem such as so-called paper jam occurs with respect to the sheet material to be taken up along the inner peripheral surface of the temporary stocking member as the take-up roller rotates, only the temporary stocking member is disassembled to expose the take-up roller to the outside, thereby making it possible to quickly solve the problem. Thus, workability in maintenance of the temporary stocking portion is improved.

Further, a printer according to the present invention includes: the temporary stocking mechanism according to the present invention; and a printing means for effecting printing on the sheet material.

As described above, according to the present invention, it is possible to down-size the temporary stocking member, improve reliability of an operation of taking up the sheet material, enable the sheet material to be smoothly taken up in the take-up space of the temporary stocking member, and increase a length of the sheet material to be taken up in the take-up space of the temporary stocking member.

DETAILED DESCRIPTION OF THE INVENTION

Hereinafter, specific embodiments of the present invention will be described with reference to the drawings.

As an example of a printer according to the present invention, a description is made on a label issuing device used for issuing a label to be affixed to a product for indicating various kinds of information on the product.

A sheet material used for the label issuing device of this embodiment includes a sheet-like base material, a heat-sensitive printing layer provided on a front surface side of the sheet-like base material, and a heat-sensitive adhesive layer provided on a rear surface side of the sheet-like base material. Note that, as required, the sheet material may adopt a structure in which, between the sheet-like base material and the heat-sensitive printing layer, a heat insulating barrier is provided, for blocking heat transfer from the layer on one side of the sheet-like base material to the layer on the other side thereof.

First Embodiment

Figure 1:
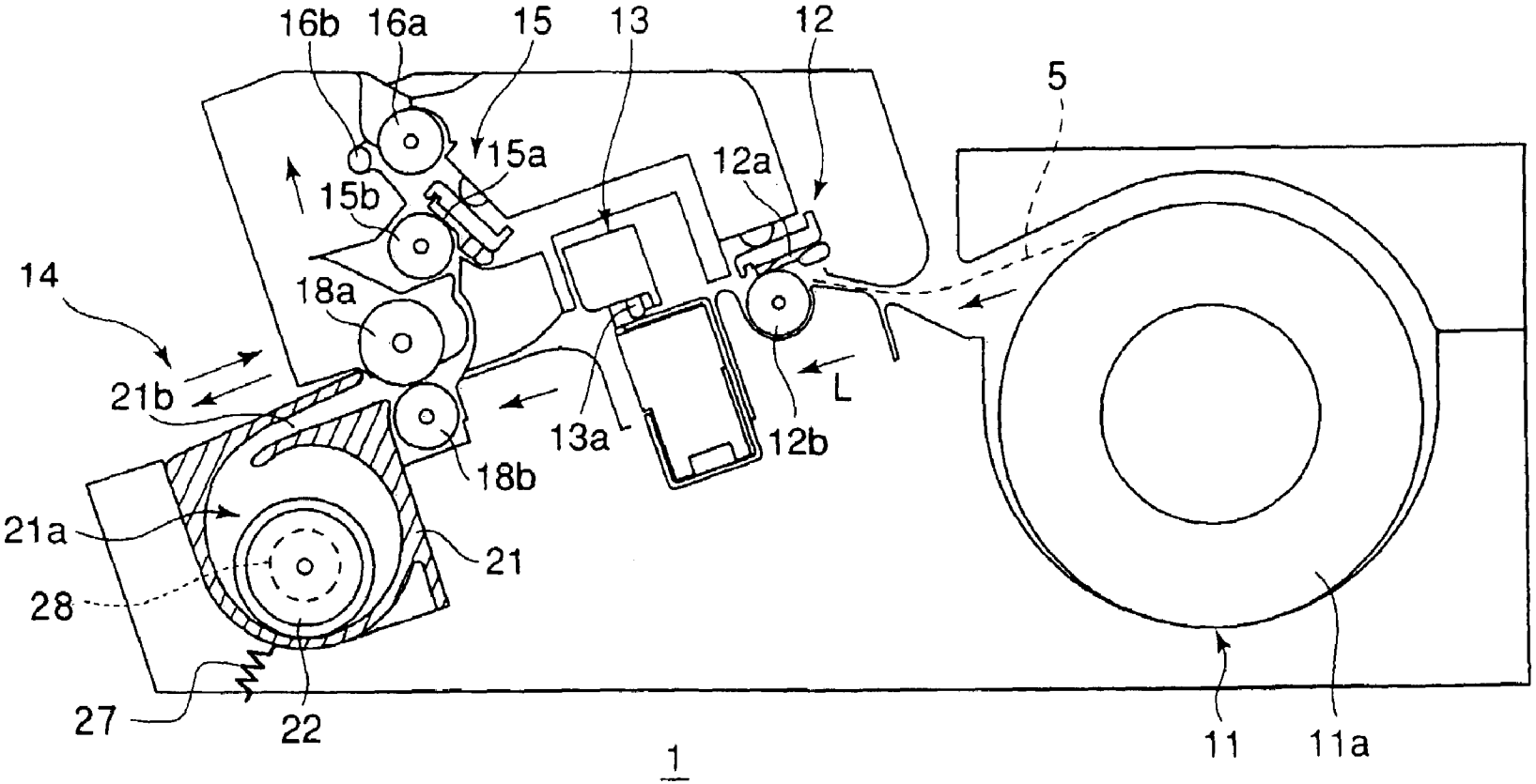
FIG. 1 is a side view schematically showing a label issuing device.

As shown in FIG. 1, a label issuing device 1 according to a first embodiment of the present invention includes a sheet supply portion 11 for supplying a sheet material 5 along a transport direction of the sheet material 5 indicated by arrows L of FIG. 1, a printing portion 12 for printing various kinds of information in a form of characters or the like on a heat-sensitive printing layer of the sheet material 5, a cutting portion 13 for cutting the sheet material 5 on which printing is effected by the printing portion 12 into a predetermined length, a temporary stocking portion 14 for temporarily stocking the sheet material 5 on which printing is effected by the printing portion 12, a thermal activation portion 15 for thermally activating a heat-sensitive adhesive layer of the sheet material 5 supplied from the temporary stocking portion 14, and a pair of discharge rollers 16*a* and 16*b* for discharging the sheet material 5 to the outside the device.

The sheet supply portion 11 is provided with a supply roll 11*a* obtained by winding the sheet material 5 into a roll, in a rotatable manner. For example, the sheet material 5 is supplied by being delivered from the supply roll 11*a* having an outer diameter of about 50 mm.

The printing portion 12 is a so-called thermal printer and includes a thermal head 12*a* for allowing the heat-sensitive printing layer of the sheet material 5 to sense heat, and a platen roller 12*b* brought into pressure contact with the thermal head 12*a*. In the printing portion 12, the sheet material 5 supplied from the sheet supply portion 11 is sandwiched between the thermal head 12*a* and the platen roller 12*b* and is subjected to printing while being transported.

The cutting portion 13 includes a cutter 13*a* for cutting the sheet material 5 transported from the printing portion 12 into a predetermined length and a cutter displacement mechanism (not shown) for moving the cutter 13*a*.

The temporary stocking portion 14 includes a pair of transport rollers 18*a* and 18*b* for transporting the sheet material 5 transported from the printing portion 12 side, a roller driving mechanism (not shown) for rotationally driving the transport rollers 18*a* and 18*b*, a temporary stocking member 21 for temporarily stocking the sheet material 5 on which printing is effected by the printing portion 12, a take-up roller 22 for taking up the sheet material 5 transported to the temporary stocking member 21, and a coil spring 27 for causing the temporary stocking member 21 to come into press contact with the take-up roller 22.

The temporary stocking member 21 is formed, for example, of a resin material and includes a cylindrical take-up space 21*a* into which the sheet material 5 transported by the transport rollers 18*a* and 18*b* is taken up. In a position adjacent to the transport rollers 18*a* and 18*b*, the temporary stocking member 21 is provided with a sheet passage 21*b* continuous with the take-up space 21*a*. Note that, the take-up space 21*a* is formed to have an inner diameter of about 25 mm and a width larger than a width of the sheet material 5.

The take-up space 21*a* is formed to be larger in width than the sheet material 5. Therefore, even in a case where a take-up position of the sheet material 5, which is wound to form the supply roll 11*a*, is moved in a width direction, that is, a so-called wind displacement in the width direction occurs, side edges of the sheet material 5 in the width direction is prevented from abutting on side walls in the width direction of the take-up space 21*a*, so the sheet material 5 can smoothly be taken up.

The temporary stocking member 21 is movably supported so as to be close to and spaced apart from the take-up roller 22. With a pressure applied from the coil spring 27, the temporary stocking member 21 is biased such that an inner peripheral surface thereof comes into contact with a peripheral surface of the take-up roller 22.

Figure 2:
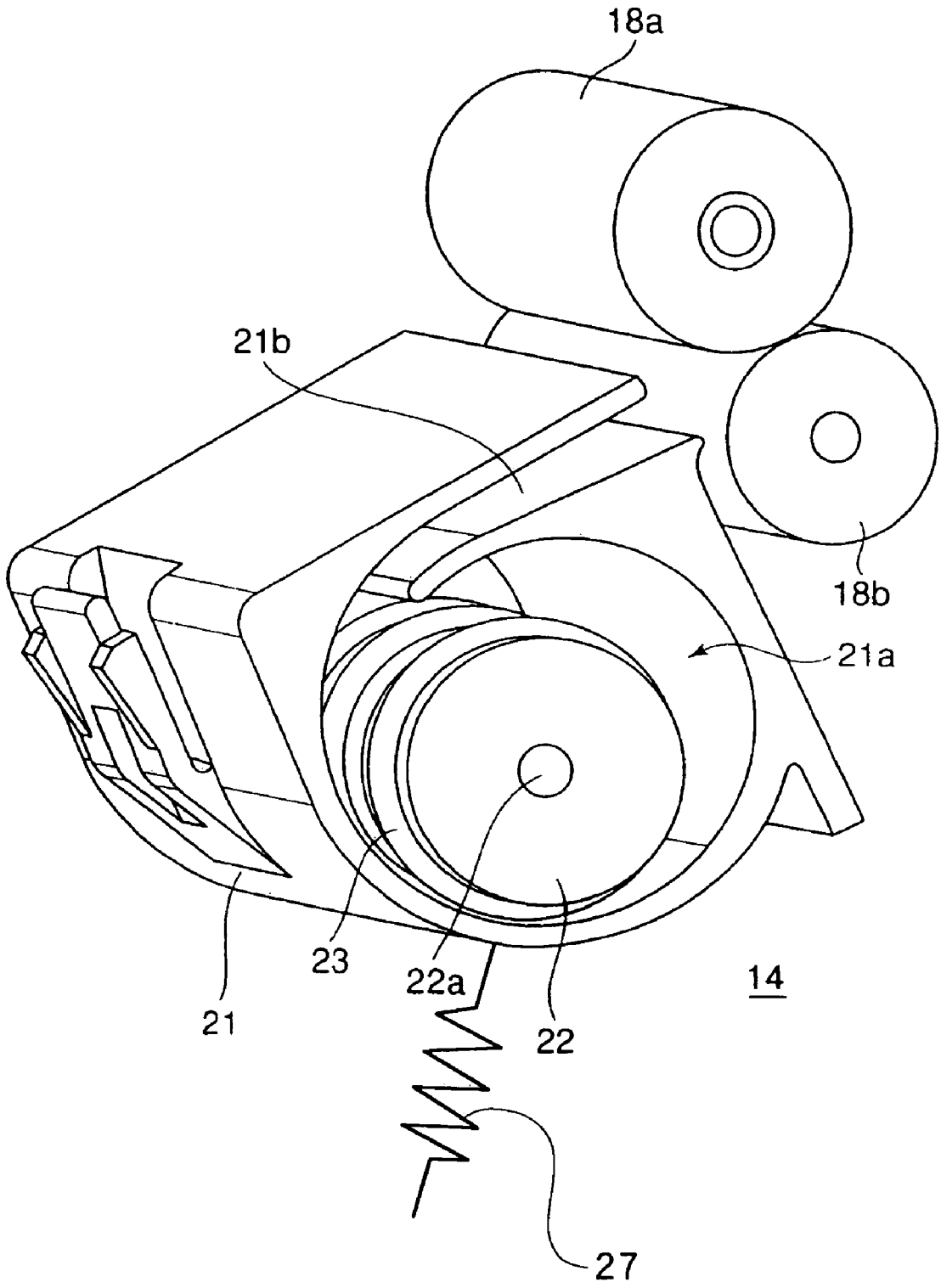
FIG. 2 is a perspective view showing a temporary stocking portion.

As shown in FIG. 2, the take-up roller 22 is arranged so as to be rotatable in a take-up space 21*a* of the temporary stocking member 21. The take-up roller 22 is supported by a rotation shaft 22*a* and can be allowed to rotate by a rotationally driving mechanism 28 through an intermediation of the rotation shaft 22*a* in a normal direction and a reverse direction. Further, the rotationally driving mechanism 28 allows the take-up roller 22 to rotationally drive in accordance with rotational speeds and rotation directions of the transport rollers 18*a* and 18*b*. rollers 18*a* and 18*b*.

Further, the take-up roller 22 is arranged in a position substantially opposed to a position of an in/out opening-of the sheet passage 21*b* of the temporary stocking member 21 with respect to a center of the take-up space 21*a* so as to abut on the inner peripheral surface of the temporary stocking member 21. That is, the sheet material 5 introduced into the take-up space 21*a* is sandwiched between the peripheral surface of the take-up roller 22 and the inner peripheral surface of the temporary stocking member 21 at a position where the sheet material 5 reaches after being advanced about halfway along the inner peripheral surface of the temporary stocking member 21, and the take-up roller 22 is rotated, thereby allowing the sheet material 5 to be advanced and smoothly taken up along the inner peripheral surface of the temporary stocking member 21.

Further, on the peripheral surface of the take-up roller 22, a plurality of ring members 23 are arranged at predetermined intervals, thereby reducing a contact area with respect to the heat-sensitive adhesive layer of the sheet material 5. Therefore, the taken-up of the sheet material 5 is easily removed from the peripheral surface of the take-up roller 22. Note that, the take-up roller 22 is formed to have a width of about 54 mm, which is a little larger than the maximum width of the sheet material 5 to be used, and an outer diameter of about 17 mm.

The thermal activation portion 15 includes a thermal activation head 15*a* for thermally activating the heat-sensitive adhesive layer of the sheet material 5 and a platen roller 15*b* which is brought into press contact with the thermal activation head 15*a*. In the thermal activation portion 15, the thermal activation head 15*a* and the platen roller 15*b* sandwich the sheet material 5 extracted from the temporary stocking portion 14 to thermally activate and transport the sheet material 5. For the thermal activating head 15*a*, the same member as that of the thermal head 12*a* of the printing portion 12 is used. In the thermal activation portion 15, there are arranged a plurality of heat generating elements (not shown) along a width direction of the sheet material 5 which is perpendicular to the transport direction thereof.

The discharge rollers 16*a* and 16*b* are arranged on a downstream side of the transport direction of the sheet material 5 with respect to the thermal activation portion 15. The discharge rollers 16*a* and 16*b* are rotationally driven by the roller driving mechanism (not shown), thereby discharging the sheet material 5 which is thermally activated in the thermal activation portion 15 to the outside of the device.

With regard to the label issuing device 1 structured as described above, description is made of an operation in which the sheet material 5 on which printing is effected by the printing portion 12 is temporarily stocked in the temporary stocking portion 14.

First, in the label issuing device 1, the sheet material 5 is supplied from the sheet supply portion 11, printing is effected on the printing layer of the sheet material 5 by the printing portion 12, and the sheet material 5 is transported to the temporary stocking portion 14 by the platen roller 15*b*.

The sheet material 5 transported to the temporary stocking portion 14 is introduced into the take-up space 21*a* along the sheet passage 21*b* by the transport rollers 18*a* and 18*b*. A leading edge of the sheet material 5 introduced into the take-up space 21*a* is advanced along the inner peripheral surface of the temporary stocking member 21 to be sandwiched between the inner peripheral surface of the temporary stocking member 21 and the take-up roller 22.

The sheet material 5 sandwiched between the temporary stocking member 21 and the take-up roller 22 is advanced in a satisfactory manner as the take-up roller 22 rotates. When the sheet material 5 is wound in the take-up space 21*a* one turn, the leading edge of the sheet material 5 further advances along an inner peripheral surface of the sheet material 5, which is wound along the inner peripheral surface of the temporary stocking member 21, to be smoothly taken up in the temporary stocking member 21. At this time, due to the rotation of the take-up roller 22, the leading edge of the sheet material 5 positioned on an innermost side of the sheet material 5 wound in the take-up space 21*a* is pushed to be taken up along the inner peripheral side of the sheet material 5.

In the temporary stocking portion 14, for example, by advancing the sheet material 5 having the width of about 28 mm to 52 mm, the sheet material 5 having a length of about 200 mm is wound in the take-up space 21*a* about two turns to be taken up in a satisfactory manner.

Next, in the label issuing device 1, the sheet material 5 is cut by the cutting portion 13 and the sheet material 5 of a desired length is stocked, and then, the pair of transport rollers 18*a* and 18*b* and the take-up roller 22 of the temporary stocking portion 14 are driven in the reverse directions, respectively, in synchronism with one another. As a result, a trailing edge of the sheet material 5 at the time of introduction into the take-up space 21*a* of the temporary stocking member 21 serves as a leading edge of the sheet material 5 extracted from the take-up space 21*a*, and the sheet material 5 is transported from the temporary stocking portion 14 to the thermal activation portion 15. The heat-sensitive layer of the sheet material 5 transported from the temporary stocking portion 14 to the thermal activating portion 15 is thermally activated, and the sheet material 5 is discharged from the label issuing device 1.

As described above, according to the label issuing device 1, inside the take-up space 21*a* of the temporary stocking member 21, there is provided the take-up roller 22 for taking up the sheet material 5. The inner peripheral surface of the temporary stocking member 21 is brought into press contact with the take-up roller 22. With this structure, the leading edge side of the sheet material 5 is sandwiched between the take-up roller 22 and the temporary stocking member 21 to be drawn into the take-up space 21*a* . Accordingly, the take-up roller 22 can take up the sheet material 5. In the label issuing device 1, in addition to an operation in which the sheet material 5 is pushed into the take-up space 21*a* by the transport rollers 18*a* and 18*b*, the leading edge side of the sheet material 5 advanced into the take-up space 21*a* is sandwiched between the take-up roller 22 and the inner peripheral surface of the temporary stocking member 21 to be smoothly drawn into the take-up space 21*a*, thereby making it possible to improve reliability of an operation of taking up the sheet material 5.

Thus, according to the label issuing device 1, it is possible to smoothly take up the sheet material 5 into the take-up space 21*a*, to down-size the temporary stocking member 21, and to increase the length of the sheet material 5 to be taken up in the take-up space 21*a*. Therefore, according to the label issuing device 1, the length of the sheet material 5 on which printing can be continuously effected in the printing portion 12 is increased, a degree of freedom of a length of a label sheet to be used increases, and a diversity of applications of the label issuing device 1 is achieved.

Second Embodiment

Next, with reference to the drawings, a description is made of a label issuing device according to a second embodiment of the present invention, including another temporary stocking portion. The label issuing device of the second embodiment has a basic structure, except a part of the temporary stocking portion, which is the same as that of the label issuing device 1 according to the first embodiment. The same members are denoted by the same reference symbols and the descriptions thereof are omitted.

Figure 3:
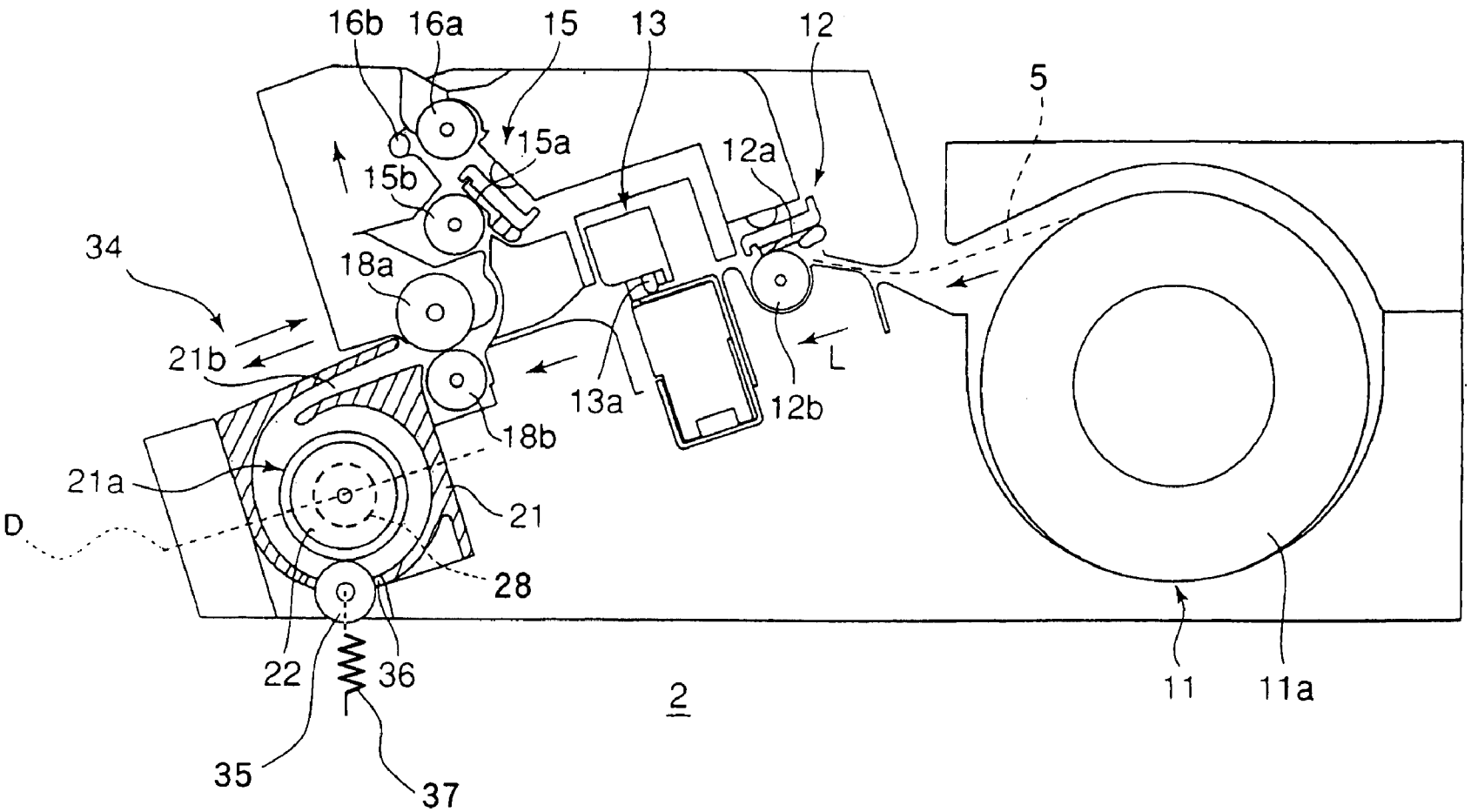
FIG. 3 is a side view schematically showing a label issuing device according to a second embodiment of the present invention.
Figure 4:
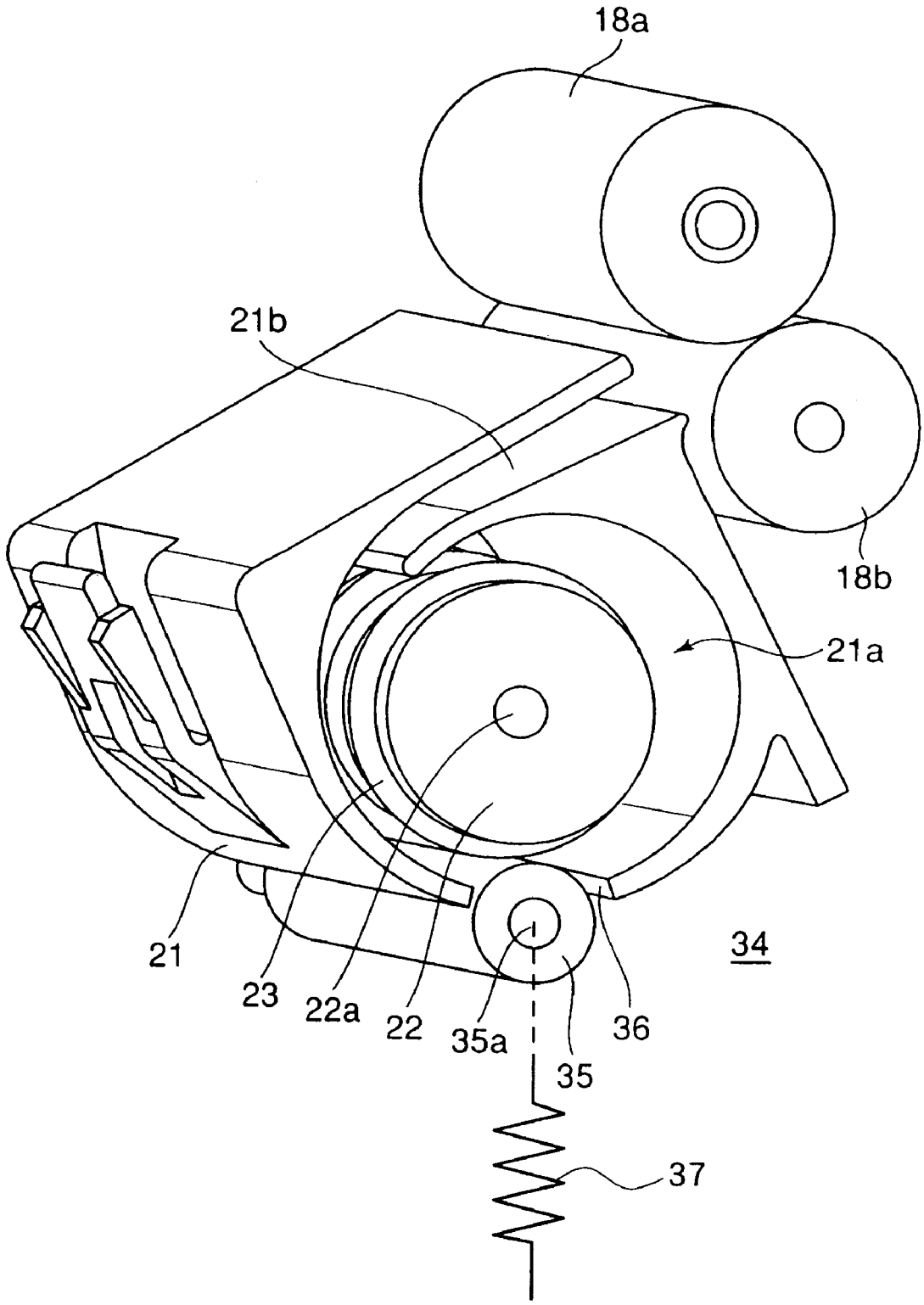
FIG. 4 is a perspective view showing another temporary stocking portion.

As shown in FIGS. 3 and 4, a temporary stocking portion 34 including a label issuing device 2 according to the second embodiment includes a driven roller 35 serving as a press-contact member, which is brought into press contact with a peripheral surface of the take-up roller 22, and a coil spring 37 serving as a press-contact means for causing a peripheral surface of the driven roller 35 to be pressed against the peripheral surface of the take-up roller 22.

A part of the temporary stocking member 21 is provided with an opening portion 36 formed in a position opposed to the driven roller 35. Through the opening portion 36, the peripheral surface of the driven roller 35 is brought into press contact with the peripheral surface of the take-up roller 22.

The driven roller 35 is supported by a rotation shaft 35*a* provided to a roller support member (not shown), and is provided so as to be movable in directions in which the driven roller 35 becomes close to and is spaced apart from the take-up roller 22 through an intermediation of the roller support member. The driven roller 35 is pressed by the coil spring 37 through the intermediation of the roller support member to be biased such that the peripheral surface of the driven roller 35 abuts on the peripheral surface of the take-up roller 22. Note that, the driven roller 35 is formed to have a width of about 54 mm, which is a little larger than the maximum width of the sheet material 5 to be used, and an outer diameter of about 5 mm.

Further, the temporary stocking portion 34 of this embodiment adopts a structure including the driven roller 35. However, the structure is not limited to the driven roller 35. For example, as long as the structure includes a press-contact member which is provided so as to be movable in directions in which the press-contact member becomes close to and is spaced apart from the peripheral surface and brought into press contact with the peripheral surface of the take-up roller 22, the press-contact member may have other forms as occasion needs.

In the label issuing device 2 structured as described above, an operation of temporarily stocking the sheet material 5, on which printing is effected by the printing portion 12, in the temporary stocking portion 34 is substantially the same as the operation in the temporary stocking portion 14. Therefore, description thereof will be simplified.

In the temporary stocking portion 34, the sheet material 5 is sandwiched between the take-up roller 22 and the driven roller 35. The sheet material 5 sandwiched between the take-up roller 22 and the driven roller 35 is advanced in a satisfactory manner as the take-up roller 22 and the driven roller 35 rotate. When the sheet material 5 is wound in the take-up space 21*a* one turn, the leading edge of the sheet material 5 further advances along the inner peripheral surface of the sheet material 5 which is wound along the outer peripheral side of the take-up space 21*a*. Accordingly, the sheet material 5 is smoothly taken up along the inner peripheral surface of the temporary stocking member 21. At this time, due to the rotation of the take-up roller 22, the leading edge of the sheet material 5, which is positioned on the innermost side of the sheet material 5 rolled in the take-up space 21*a*, is pushed along the inner peripheral side of the sheet material 5 to be taken up.

In the temporary stocking portion 34, for example, the sheet material 5 having the width of about 28 mm to 52 mm is taken up in the temporary stocking member 21, so the sheet material 5 is smoothly wound in the take-up space 21*a* about four turns. Accordingly, the sheet material 5 having the length of about 350 mm is taken up in a satisfactory manner.

Further, in the temporary stocking portion 34, the sheet material 5 is cut by the cutting portion 13 and the sheet material 5 of the desired length is stocked, and then, the pair of transport rollers 18*a* and 18*b*, the take-up roller 22, and the driven roller 35 of the temporary stocking portion 34 are driven in reverse directions, respectively, in synchronism with one another. As a result, the sheet material 5 is transported from the temporary stocking portion 34 to the thermal activation portion 15. According to the label issuing device 2 of this embodiment, there is provided the temporary stocking portion 34 having the driven roller 35 to. be brought into press contact with the take-up roller 22 for taking up the sheet material 5, thereby allowing the sheet material 5 to be sandwiched between the take-up roller 22 and the driven roller 35, so it is possible to further improve reliability of the operation of taking up the sheet material 5. Thus, according to the temporary stocking portion 34, the sheet material 5 is taken up in the take up space 21*a* more smoothly, thereby increasing the length of the sheet material 5 to be taken up in the temporary stocking member 21.

Further, it is preferable that the temporary stocking member 21 described above be structured in a manner in which the take-up roller 22 in the take-up space 21*a* can be exposed to the outside. For example, the temporary stocking member 21 may be structured so as to be capable of being divided into an upper component and a lower component as shown by a broken line D of FIG. 3. According to this construction, in a case where a problem occurs such as so-called paper jam of the sheet material 5 to be taken up in the temporary stocking member 21, by disassembling only the temporary stocking member, the take-up roller 22 is exposed to the outside, there by making it possible to quickly solve the problem. As a result, it is possible to improve workability in maintenance of the temporary stocking portion.

Note that, in this embodiment, the sheet material 5 having the heat-sensitive printing layer is described as one example. However, as a matter of course, the present invention may be applied, for example, to a purpose of temporarily stocking the sheet material on which printing is effected by allowing ink droplets to adhere onto the printing layer thereof to be absorbed therein by using an ink jet recording method.

Further, as the printer according to the present invention, the above-mentioned label issuing device is exemplified. However, the printer is not limited to the structure employing the sheet material having the heat-sensitive layer, the printer may have a structure in which the sheet material on which printing is effected is temporarily stocked, and then, is discharged from the temporary stocking portion.

The invention claimed is:

1. A temporary stocking mechanism, comprising:

a temporary stocking member having a cylindrical take-up space in which a sheet material is taken up, for temporarily stocking the sheet material on which printing is effected by a printing means;

a take-up roller provided in the take-up space, for taking up the sheet material;

a driving means for rotationally driving the take-up roller; and a press-contact means for bringing a peripheral surface of the take-up roller into press contact with an inner peripheral surface of the temporary stocking member.

2. The temporary stocking mechanism according to claim 1, wherein:

the temporary stocking member is provided so that the temporary stocking member is capable of moving in directions in which the temporary stocking member becomes close to and is spaced apart from the take-up roller; and the press-contact means biases the temporary stocking member so that the temporary stocking member is brought into press contact with the take-up roller.

3. The temporary stocking mechanism according to claim 1, wherein the temporary stocking member comprises a plurality of members which are combined with one another so as to be capable of being separated so that the take-up roller is exposed to an out side.

4. The temporary stocking mechanism according to claim 1, wherein the sheet material comprises: a sheet-like base material;

a printing layer provided on one side of the sheet-like base material;

and a heat-sensitive adhesive layer provided on another side of the sheet-like base material.

5. A printer comprising:

a temporary stocking mechanism according to claim 1; and a printing means for effecting printing on the sheet material.

6. A temporary stocking mechanism, comprising:

a temporary stocking member having a cylindrical take-up space in which a sheet material is taken up, for temporarily stocking the sheet material on which printing is effected by a printing means;

a take-up roller provided in the take-up space, for taking up the sheet material;

a driving means for rotationally driving the take-up roller;

a press-contact member brought into press contact with the take-up roller; and a press-contact means for pressing the press-contact member against a peripheral surface of the take-up roller.

7. The temporary stocking mechanism according to claim 6, wherein:

the press-contact member is provided so that the press-contact member is capable of moving in directions in which the press-contact member becomes, close to and is spaced apart from the take-up roller; and the press-contact means biases the press-contact member so that the press-contact member is brought into press contact with the take-up roller.

8. The temporary stocking mechanism according to claim 6, wherein the press-contact member comprises a driven roller which is driven with rotation of the take-up roller.

9. The temporary stocking mechanism according to claim 6, wherein the temporary stocking member comprises a plurality of members which are combined with one another so as to be capable of being separated so that the take-up roller is exposed to an outside.

10. The temporary stocking mechanism according to claim 6, wherein the sheet material comprises: a sheet-like base material; a printing layer provided on one side of the sheet-like base material; and a heat-sensitive adhesive layer provided on another side of the sheet-like base material.

11. A printer comprising:

a temporary stocking mechanism according to claim 6; and a printing means for effecting printing on the sheet material.

12. The printer according to claim 11, further comprising a thermal activation means arranged on a downstream side in a transport direction of the sheet material with respect to the printing means, for thermally activating a heat-sensitive adhesive layer of the sheet material, wherein the temporary stocking member is arranged in a transport passage of the sheet material between the printing means and the thermal activation means.

* * * * *